US011223905B2

(12) United States Patent
Zhao et al.

(10) Patent No.: US 11,223,905 B2
(45) Date of Patent: Jan. 11, 2022

(54) SOUND GENERATOR AND ELECTRONIC PRODUCT

(71) Applicant: Goertek Inc., Shandong (CN)

(72) Inventors: Guodong Zhao, Weifang (CN); Peijun Li, Weifang (CN); Yaqian Ji, Weifang (CN); Zhilei Han, Weifang (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 16/975,254

(22) PCT Filed: Dec. 25, 2018

(86) PCT No.: PCT/CN2018/123300
§ 371 (c)(1),
(2) Date: Aug. 24, 2020

(87) PCT Pub. No.: WO2019/161703
PCT Pub. Date: Aug. 29, 2019

(65) Prior Publication Data

US 2020/0404425 A1 Dec. 24, 2020

(30) Foreign Application Priority Data

Feb. 26, 2018 (CN) ..... 201810160281.5

(51) Int. Cl.
*H04R 9/02* (2006.01)
*H04R 9/04* (2006.01)
*H04R 9/06* (2006.01)

(52) U.S. Cl.
CPC ..... *H04R 9/025* (2013.01); *H04R 9/046* (2013.01); *H04R 9/06* (2013.01); *H04R 2209/022* (2013.01); *H04R 2400/11* (2013.01)

(58) Field of Classification Search
CPC ..... H04R 9/025; H04R 9/06; H04R 9/046; H04R 2400/11; H04R 2209/022
See application file for complete search history.

(56) References Cited

U.S. PATENT DOCUMENTS 9,883,280 B2 * 1/2018 Oosato ..... H04R 1/2857
2007/0147649 A1 * 6/2007 Takase ..... H04R 1/023 381/396
2015/0110336 A1 * 4/2015 Song ..... H04R 1/02 381/412

* cited by examiner

*Primary Examiner* — Sunita Joshi
(74) *Attorney, Agent, or Firm* — Baker Botts, L.L.P.

(57) ABSTRACT

A sound generator comprises a shell, a vibration system and a magnetic circuit system sequentially accommodated and fixed at a first end of the shell from top to bottom; the magnetic circuit system is provided with a rear sound hole; the shell comprises a first portion corresponding to the vibration system and the magnetic circuit system, and a second portion integrally extending downward from the first portion beyond a bottom surface of the magnetic circuit system. A second end portion of the shell is integrally provided with a shell bottom wall or separately mounted with a lower cover plate; and a rear cavity in communication with the rear sound hole is formed.

15 Claims, 6 Drawing Sheets

SOUND GENERATOR AND ELECTRONIC PRODUCT

CROSS-REFERENCE TO RELATED APPLICATIONS

This application is a National Stage of International Application No. PCT/CN208/123300, filed on Dec. 25, 2018, which claims priority to Chinese Patent Application No. 201810160281.5, filed on Feb. 26, 2018, both of which are hereby incorporated by reference in their entireties.

TECHNICAL FIELD

The present disclosure relates to the technical field of sound generating device.

BACKGROUND

A sound generating device is an important component among electronic products, and is used to convert electrical signals into acoustic signals. The electronic products have a development trend of getting thinner and thinner and tend to have more and more components contained therein in order to realize more functions, as such, space reserved therein for the sound generating device is bound to become smaller and smaller. In addition, more and more attention has been drawn to users' music experience from electronic products, and the sound generating device is required to have better sound quality.

In order to improve performance on music experience, prior art sound generating devices have a sound generator installed in a box with a certain volume. The sound generator includes a shell, as well as a magnetic circuit system and a vibration system accommodated and fixed in the shell. A rear cavity is formed between the sound generator and the box. The larger the rear cavity, the lower the low-frequency resonance frequency of the product, thereby the low-frequency performance of the product is improved. The sound generating device in the prior art typically has a structure with an accommodating cavity for accommodating a sound generator in the box, and a rear cavity on a side of the sound generator. Although forming the rear cavity on the side of the sound generator can realize the largest possible rear cavity volume, but at the same time, it also leads to a larger space occupation by the entire sound generating device in a horizontal direction, which is not conducive to the miniaturization of the product.

Furthermore, the sound generating device of the prior art is irregular in the shape of the rear cavity, and the airflow from the sound generator into the rear cavity is not stable enough, which is easy to cause problems such as polarization and distortion, resulting in an unsatisfactory acoustic effect.

If the volume of the sound generating device of the existing structure is reduced, the volume of the rear cavity of the sound generating device is bound to be reduced. Therefore, it is necessary to provide a novel structured sound generating device with a small volume while maintaining good performance to meet the development needs of electronic products.

SUMMARY

The embodiment of the invention provides a sound generator and an electronic product, which meets the requirements of miniaturization design and has the function of preventing magnetic leakage.

The invention provides a sound generator, comprising a shell, a vibration system and a magnetic circuit system; wherein, the vibration system and the magnetic circuit system are sequentially accommodated and fixed at a first end of the shell from top to bottom; the magnetic circuit system is provided with a rear sound hole; the shell comprises a first portion corresponding to the vibration system and the magnetic circuit system, and a second portion integrally extending downward from the first portion beyond a bottom surface of the magnetic circuit system; a second end portion of the shell is integrally provided with a shell bottom wall or separately mounted with a lower cover plate; and a rear cavity in communication with the rear sound hole is formed between the second portion of the shell, the bottom surface of the magnetic circuit system and the shell bottom wall or the lower cover plate; the shell comprises a side wall, a metal sheet for shielding magnetic leakage being provided on the side wall of the shell.

Optionally, the shell is a straight cylinder structure with openings at both ends; the vibration system comprises a diaphragm and a voice coil fixed below the diaphragm, the diaphragm being fixed on an end surface of a first end opening of the shell; and the lower cover plate is mounted at a second end opening of the shell.

Optionally, the metal sheet is an individual component, and the metal sheet is injection-molded and fixed on the side wall of the shell.

Optionally, the lower cover plate is mounted at the second end opening of the shell; the lower cover plate is made of a metal, the metal sheet is integrally provided with the lower cover plate, the metal sheet is formed by a bent-upwards extension of an edge of the lower cover plate, and the metal sheet is fixed on the side wall of the shell.

Optionally, a groove is provided on a position, corresponding to the metal sheet, on the side wall of the shell, and the metal sheet is embedded in the groove and fixed to a bottom of the groove.

Optionally, the metal sheet comprises a main body portion fixed on the side wall of the shell, and at least one fixing portion bent outwards from an end of the main body portion, and a positioning hole is provided on the fixing portion.

Optionally, the magnetic circuit system comprises a magnetic conductive yoke, and a central magnetic circuit portion and a side magnetic circuit portion that are mounted on an upper surface of the magnetic conductive yoke; a magnetic gap is formed between the central magnetic circuit portion and the side magnetic circuit portion; and at least one of the central magnetic circuit portion and the side magnetic circuit portion is provided with a permanent magnet.

Optionally, an outer side of the magnetic circuit system is provided in close contact with an inner wall of the shell.

Optionally, the magnetic conductive yoke is rectangular, and a corner of the magnetic conductive yoke is provided with a first rear sound hole in communication with the magnetic gap and the rear cavity; the rear sound hole comprises the first rear sound hole.

Optionally, the central magnetic circuit portion comprises a central magnet and a central magnetic conductive plate provided on a top surface of the central magnet; at the central magnetic circuit portion, the magnetic circuit system is provided with a through hole that sequentially penetrates the magnetic conductive yoke and the central magnet as a part of the rear cavity, and a second rear sound hole in communication with the through hole is provided on the central magnetic conductive plate; the rear sound hole comprises the second rear sound hole.

Optionally, an upper cover plate mounted on the shell is provided above the diaphragm.

Optionally, the shell is of a rectangular structure.

Optionally, the rear sound hole is provided with a breathable spacer, and the rear cavity is filled with a sound absorbing material.

Optionally, the shell bottom wall or the lower cover plate is provided with a filling hole for filling the sound absorbing material, and a cover sheet is encapsulated on the filling hole.

Optionally, the lower cover plate is mounted at the second end opening of the shell, and the lower cover plate is made of a metal; an inner side of an end surface of the second end opening of the shell is provided with a recessed second stepped end surface, the second stepped end surface is provided with a top surface and a side surface for mounting the lower cover plate; the lower cover plate is of a flat plate shape, an edge of the lower cover plate is provided with a recessed portion recessed towards the rear cavity, the recessed portion abuts on the top surface of the second stepped end surface, and a first glue holding groove is formed between the recessed portion and the side surface of the second stepped end surface, and the first glue holding groove is coated with glue to fix the lower cover plate on the shell; or, the lower cover plate is of a bowl-shaped structure provided with a bottom wall and a side wall, an end of the side wall of the lower cover plate is bent outward to provide a mounting edge, the mounting edge abuts on the top surface of the second stepped end surface, and a second glue holding groove is formed between the mounting edge and the side surface of the second stepped end surface, and the second glue holding groove is coated with glue to fix the lower cover plate on the shell; or a plastic edge is injection-molded on a periphery of the lower cover plate, and the plastic edge is ultrasonically welded to the second end opening of the shell.

The invention further provides an electronic product, comprising an assembly case of the electronic product, wherein the above sound generator is mounted in the assembly case; the metal sheet comprises a main body portion fixed on the side wall of the shell, and at least one fixing portion bent outwards from an end of the main body portion, and a positioning hole is provided on the fixing portion; the sound generator and the assembly case are fixed together by the positioning hole on the fixing portion; and, a camera is mounted at a position, corresponding to a side, provided with the metal sheet of the sound generator, in the assembly case.

In the technical solution provided in the embodiment of the invention, the shell comprises a first portion corresponding to the vibration system and the magnetic circuit system, and a second portion integrally extending downward from the first portion beyond a bottom surface of the magnetic circuit system; and a second end portion of the shell is integrally provided with a shell bottom wall or separately mounted with a lower cover plate, and a rear cavity being formed between the second portion of the shell, the magnetic circuit system, and the shell bottom wall or the lower cover plate. Compared with the prior art, the invention directly forms a sufficiently large rear cavity space with the lower end portion of the shell of the sound generator. Firstly, there is no need to additionally configure the box structure forming the rear cavity, thus it will not increase the occupied space in the horizontal direction, and the peripheral area of the shell of the sound generator determines the size of the space occupied by the entire sound generating device in the electronic product, which helps to achieve miniaturization of the product, and on the basis of miniaturization, it can take into account the volume of the magnetic circuit system and the volume of the rear cavity, thereby ensuring acoustic performance. Secondly, a rear cavity is arranged directly below the vibration system and the magnetic circuit system, and the rear cavity has a regular shape and is close to the rear acoustic hole. Compared with the prior art, the same large rear cavity volume can achieve a better acoustic effect. In addition, the technical solution provided by the embodiments of the invention is only to extend the design of the shell of the sound generator, the structure is simple, and there is no need to perform the assemble between the sound generator and the box or the box structure, which can simplify the manufacturing process and mounting process and increase the production efficiency. In addition, in the embodiment of the present invention, a metal sheet is provided on the side wall of the shell to achieve the function of preventing magnetic leakage.

Other features and advantages of the invention will become clear from the following detailed description of exemplary embodiments of the invention with reference to the drawings.

BRIEF DESCRIPTION OF THE DRAWINGS

The drawings that form a part of the description describe embodiments of the invention, and together with the description serve to explain the principles of the invention.

DETAILED DESCRIPTION

Figure 1:
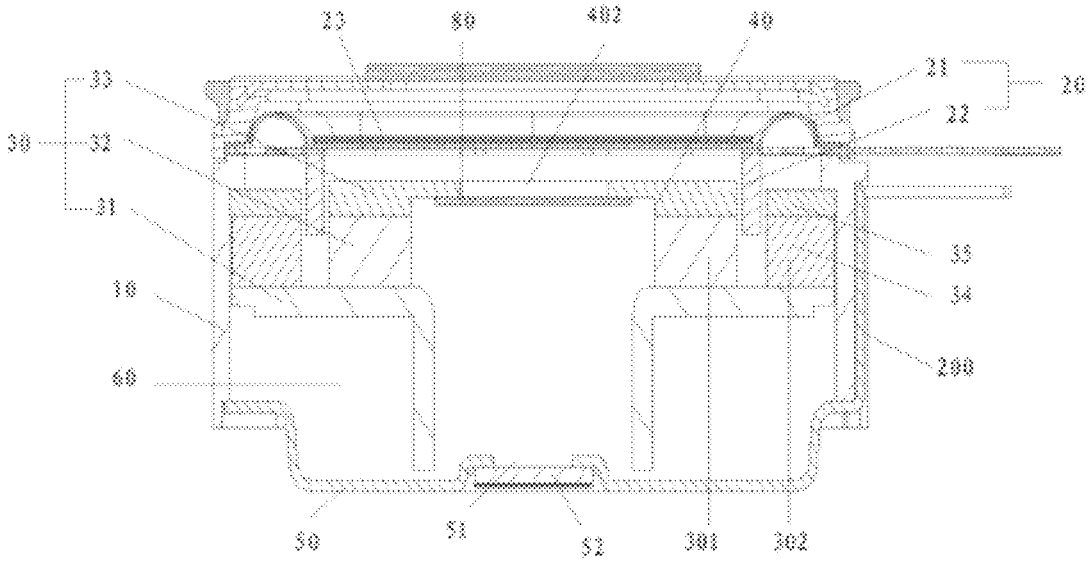
FIG. 1 is a schematic cross-sectional view of a sound generator provided by an embodiment of the invention.

Various exemplary embodiments of the invention will now be described in detail with reference to the drawings. It should be noted that; unless specifically stated otherwise, the relative arrangement of components and steps, numerical expressions, and numerical values set forth in these embodiments do not limit the scope of the invention. The following description of at least one exemplary embodiment is actually merely illustrative, and in no way serves as any limitation on the invention and its application or use.

Techniques and devices known to those of ordinary skill in the related art may not be discussed in detail, but the techniques and devices should be considered as part of the description where appropriate. In all examples shown and discussed herein, any specific values should be interpreted as exemplary only and not as limitations. Therefore, other examples of the exemplary embodiment may have different values. It should be noted that; Similar reference numerals and letters indicate similar items in the following drawings. Therefore, once an item is defined in one drawing, there is no need to discuss it further in subsequent drawings.

Figure 2:
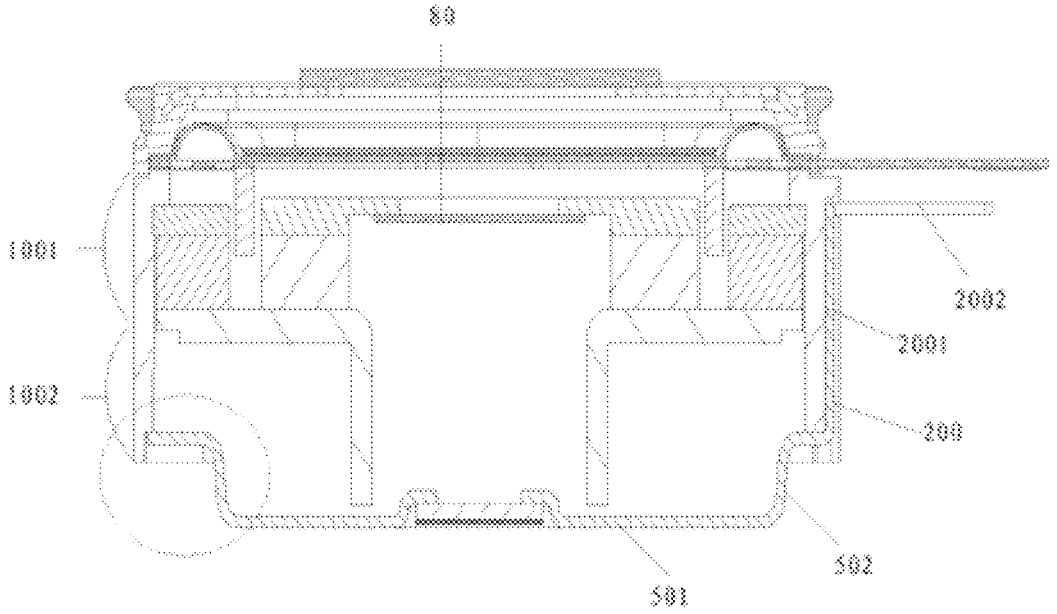
FIG. 2 is an another schematic cross-sectional view of a sound generator provided by an embodiment of the invention.

FIGS. 1 and 2 show a structural schematic view of a sound generator provided by an embodiment of the present invention. As shown in FIGS. 1 and 2, a shell 10, a vibration system 20 and a magnetic circuit system 30 are included. The vibration system 20 and the magnetic circuit system 30 are sequentially accommodated and fixed at a first end of the shell 10 from top to bottom. The magnetic circuit system 30 is located below the vibration system 20 and fixed in the shell 10, and the magnetic circuit system 30 is provided with a rear sound hole 40. As shown in FIG. 2, the shell 10 comprises a first portion 1001 corresponding to the vibration system 20 and the magnetic circuit system 30, and a second portion 1002 integrally extending downward from the first portion 1001 beyond a bottom surface of the magnetic circuit system 30. A second end portion of the shell 10 is integrally provided with a shell bottom wall (not shown in the figures) or separately mounted with a lower cover plate 50; and a rear cavity 60 which is in communication with the rear sound hole 40 is formed between the second portion 1002 of the shell, the bottom surface of the magnetic circuit system 30, and the shell bottom wall or the lower cover plate 50; the shell 10 comprises a side wall, a metal sheet 200 for shielding magnetic leakage being provided on the side wall of the shell 10.

According to the actual situation, the above-mentioned shell 10 may be selected to have one end opening or two end opening structures. One end opening structure may be an upper end opening or a lower end opening, and the other end is a closed end. When the closed end is an upper end corresponding to the vibration system, it is allowed to open a small sound hole on the closed end, and after assembling the vibration system and the magnetic circuit system from the opening end, close the open end with a cover plate.

In a specific implementation structure, the shell 10 is a straight cylinder structure with opening at both ends; as shown in FIGS. 1 and 2, a vibration system 20 is installed at a first end opening of the shell 10; the vibration system 20 comprises a diaphragm 521 and a voice coil 22 fixed below the diaphragm 21, the diaphragm 21 being fixed on an end surface of a first end opening of the shell 10; and the lower cover plate 50 is mounted at the second end opening of the shell 10.

A metal sheet is provided on the side wall of the shell 10 to shield the magnetic leakage of the magnetic circuit system to avoid the influence of the magnetic leakage of the magnetic circuit system on external circuits.

Compared with the prior art, the technical solution provided by the embodiments of the invention directly forms a sufficiently large rear cavity space from the lower end portion of the shell of the sound generator. There is no need to additionally configure the box structure forming the rear cavity, thus it will not increase the occupied space in the horizontal direction, and the peripheral area of the shell of the sound generator determines the size of the space occupied by the entire sound generating device in the electronic product, which helps to achieve miniaturization of the product, and on the basis of miniaturization, it can take into account the volume of the magnetic circuit system and the volume of the rear cavity, thereby ensuring acoustic performance. Secondly, a rear cavity is arranged directly below the vibration system and the magnetic circuit system, and the rear cavity has a regular shape and is close to the rear acoustic hole. Compared with the prior art, a better acoustic effect can be achieved with the same large rear cavity volume. In addition, the technical solution provided by the embodiments of the invention is only to lengthen the design of the shell of the sound generator, with a simple structure, and there is no need to perform the assemble between the sound generator and the box or the box structure, which can simplify the manufacturing process and mounting process and increase the production efficiency. In addition, in the embodiment of the present invention, a metal sheet is provided on the side wall of the shell to realize the function of preventing the magnetic leakage.

Figure 3:
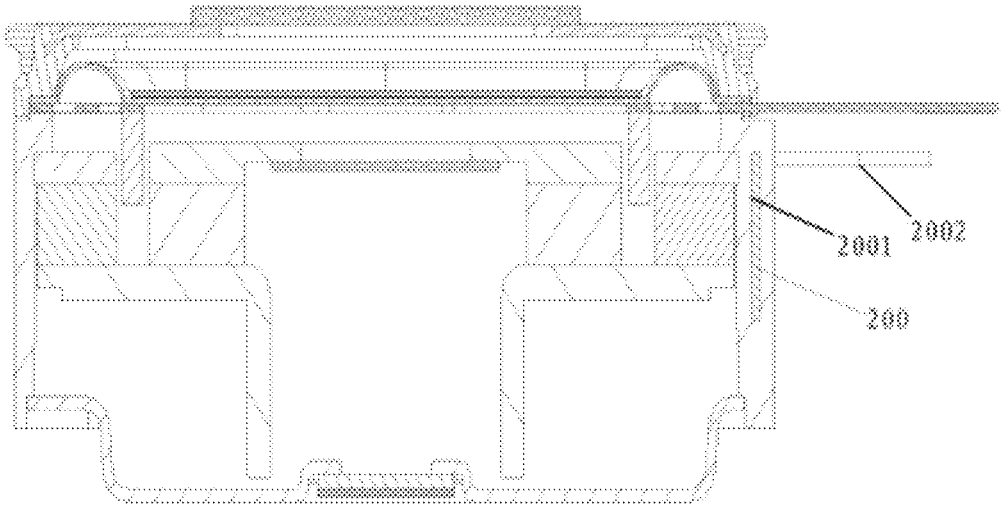
FIG. 3 is an another schematic cross-sectional view of a sound generator provided by an embodiment of the invention.
Figure 9:
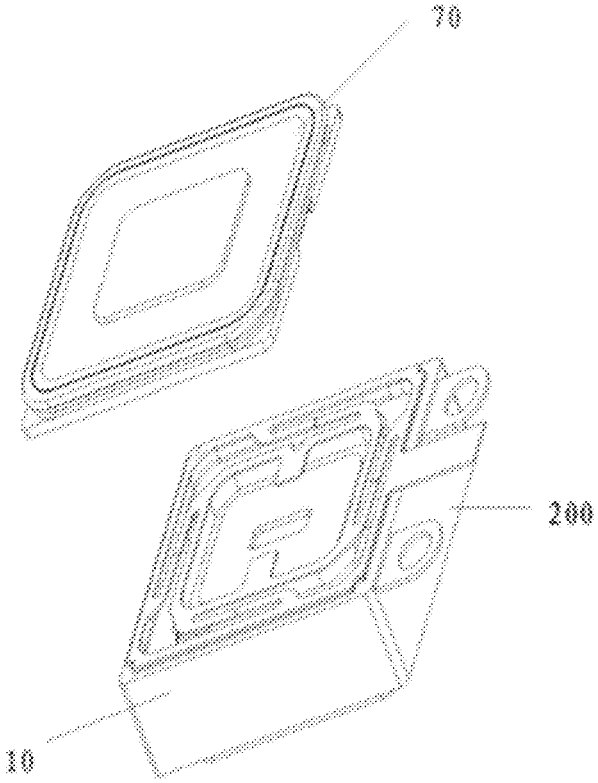
FIG. 9 is an exploded schematic view of the sound generator when the metal sheet provided by an embodiment of the present invention is an individual component.
Figure 10:
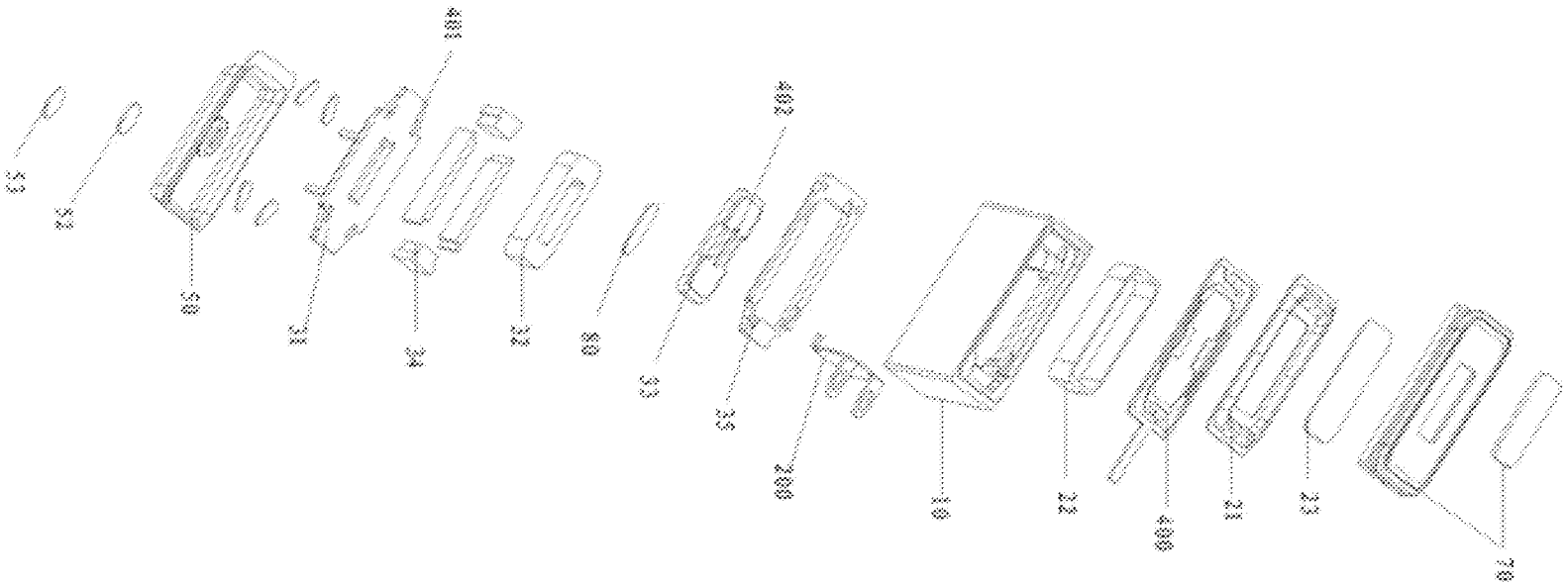
FIG. 10 is an exploded schematic view of a sound generator provided by another embodiment of the present invention.

During specific implementation, the metal sheet 200 may be set in one of the following ways:

Method One: as shown in FIGS. 3, 9 and 10, the metal sheet 200 is an individual component and the metal sheet 200 is injection-molded and fixed on the side wall of the shell 10.

Method Two: as shown in FIG. 1, the lower cover plate 50 is mounted at the second end opening of the shell 10; the lower cover plate 50 is made of a metal, the metal sheet 200 is integrally provided with the lower cover plate 50, the metal sheet 200 is formed by a bent-upwards extension of an edge of the lower cover plate 50, and the metal sheet 200 is fixed on the side wall of the shell 10.

Figure 4:
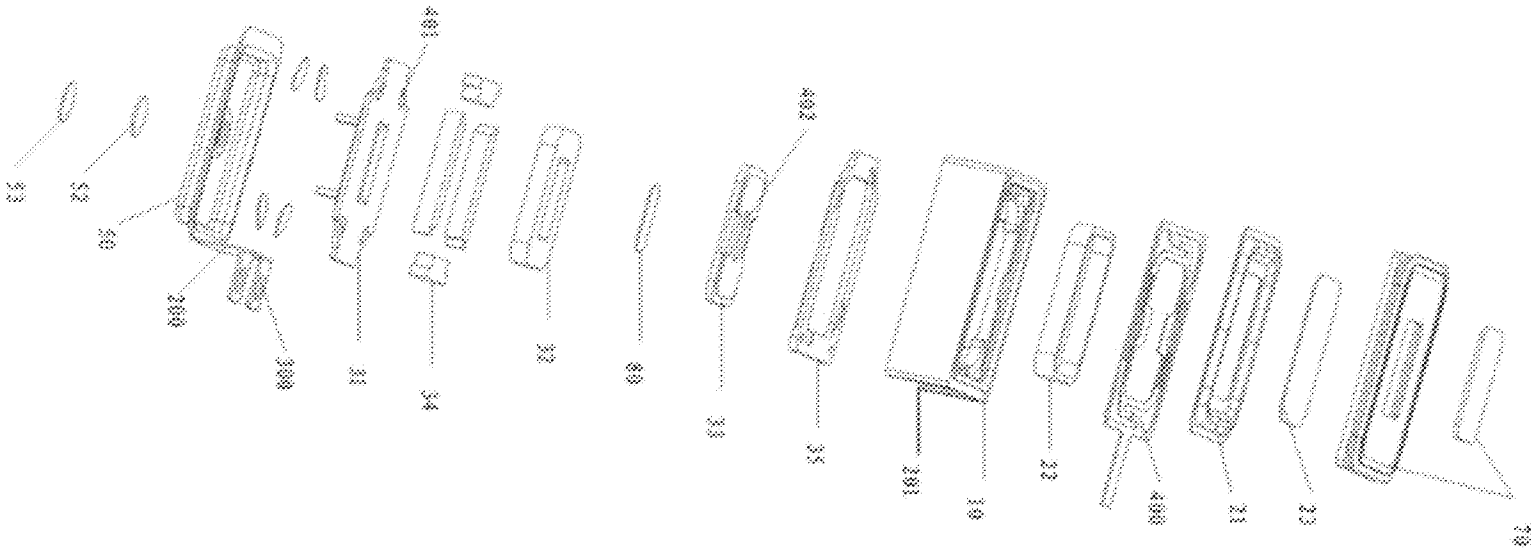
FIG. 4 is an exploded schematic view of a sound generator provided by an embodiment of the invention.
Figure 8:
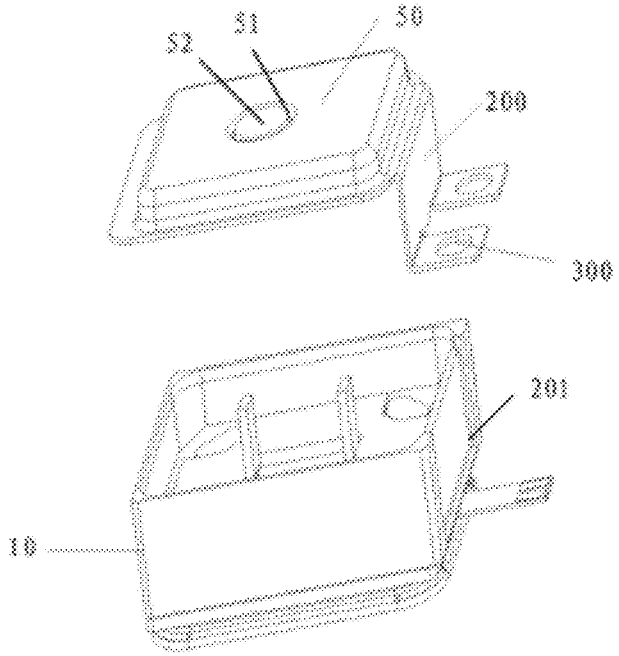
FIG. 8 is an exploded schematic view of the sound generator when the lower cover plate and the metal sheet are provided as an integrated structure according to an embodiment of the present invention.

In the above method two, the metal sheet 200 may be bonded to the side wall of the shell 10 by glue, or a groove 201 is provided on a position, corresponding to the metal sheet 200, on the side wall of the shell 10 (as shown in FIGS. 4 and 8), and the metal sheet 200 is embedded in the groove 201 and fixed to a bottom of the groove 201. The integrally formed lower cover plate 50 and the metal sheet 200 not only realize the sealing of the rear cavity 60, but also realize the shielding of magnetic leakage.

Further, as shown in FIGS. 2, 3 and 4, the metal sheet 200 comprises a main body portion 2001 fixed on the side wall of the shell 10, and at least one fixing portion 2002 bent outwards from an end of the main body portion 2001, and a positioning hole 300 is provided on the fixing portion 2002. The positioning hole 300 on the fixing portion 2002 can realize not only the positioning of the speaker module in the electronic device, but also have the speaker module and the electronic device fixed by the positioning hole 300. The positioning hole 300 includes but is not limited to a screw hole, and the speaker module is fixed to the electronic device by screws. As shown in FIG. 4, there are two fixing portions 2002.

In a specific structural implementation, as shown in FIGS. 1 and 4, the magnetic circuit system 30 comprises a magnetic conductive yoke 31, and a central magnetic circuit portion 301 mounted on an upper surface of the magnetic conductive yoke 31 and a side magnetic circuit portion 302; a magnetic gap is formed between the central magnetic circuit portion 301 and the side magnetic circuit portion 302; and at least one of the central magnetic circuit portion 301 and the side magnetic circuit portion 302 is provided with a permanent magnet. In particular, the central magnetic circuit portion 301 comprises a central magnet 32 and a central magnetic conductive plate 33. The side magnetic circuit portion 302 comprises a side magnetic conductive plate 35 and a side magnet 34. The voice coil 22 in the vibration system 20 is suspended in the magnetic gap.

In order to reduce the volume of the sound generator and maximize the magnetic circuit system, as shown in FIG. 2, the outer side of the magnetic circuit portion 30 is provided in close contact with the inner wall of the shell 10. Further, the peripheral side of the magnetic conductive yoke 31 and the inner wall of the shell 10 are also provided in close contact with each other.

Further, the magnetic conductive yoke 31 may be rectangular, and a corner of the corresponding magnetic conductive yoke 31 may be provided with a first rear sound hole in communication with the magnetic gap and the rear cavity 60. More specifically, as shown in FIGS. 4 and 10, the magnetic conductive yoke 31 is a polygonal structure with four corners provided with notches; the corner positions of the magnetic conductive yoke 31, that is, near the edges of the notches, a first rear sound hole 401 in communication with the magnetic gap and the rear cavity 60 is provided.

Furthermore, as shown in FIGS. 1 and 4, the central magnetic circuit portion 301 of the magnetic circuit system 30 includes a central magnet 32 and a central magnetic conductive plate 33 provided on the top surface of the central magnet 32. At the central magnetic circuit portion 301, the magnetic circuit system 30 is provided with a through hole that sequentially penetrates the magnetic conductive yoke 31 and the central magnet 32 as a part of the rear cavity 60, and a second rear sound hole 402 in communication with the through hole is provided on the central magnetic conductive plate 33.

The four first rear acoustic holes at the four corners of the magnetic conductive yoke 31 cannot achieve the best air circulation effect with the rear cavity 60, thus in this embodiment, a second rear sound hole 402 in communication with the through holes in the magnetic conductive yoke 31 and the central magnet 32 is provided on the central magnetic conductive plate 33 as a No. 5 rear sound hole.

The four first rear sound holes 401 and the second rear sound hole 402 together constitute the rear sound hole 40 provided on the magnetic circuit system. The No. 5 rear sound hole can not only play the role of expanding the capacity of the acoustic cavity 60, but also solve the problem that the acoustic resistance of the vibration becomes larger to make the stability of the vibration system becoming worse since the distance between the vibration system and the magnetic circuit of the miniaturized device is small.

Additional explanation to be made here is that the central area of the central magnet 32 contributes less to the BL of the sound generator (a parameter which measures the strength of the driving system in the sound generator) than the boundary area. Therefore, when the volume of the rear cavity 60 is limited, the center area of the central magnet 32 is hollowed-out to increase the volume of the rear cavity, which helps to improve the performance of the product. Although influence of the hollowed-out area of the central magnet 32 on the BL value of the magnetic circuit system 30 is small, the influence is somewhat unneglectable. If the hollowed-out area of the central magnet 32 is too large, its influence on the BL value of the magnetic circuit system 30 cannot be ignored. If the hollowed-out area is too large, the BL value of the magnetic circuit system 30 will be smaller, and the performance of the product will be lower. Therefore, it is necessary to find a balance range such that the increase of the volume of the rear cavity 60 since the center magnet 32 is hollowed-out improves the product performance more than the reduction in the BL value of the magnetic circuit system reduces the product performance, thereby optimizing the product performance. Through simulation, it is known that when the hollowed-out volume of the center magnet 32 accounts for less than 35% of the original volume of the center magnet, the product performance is improved. When the hollowed-out volume of the center magnet 32 exceeds this range, the BL value of the magnetic circuit system 30 sharply decreases. At this time, the increase in the space of the rear cavity 60 has a lower performance improvement effect than the product performance reduction effect caused by the decrease of the BL value of the magnetic circuit system, and the overall performance is the reduction of product performance. Therefore, in the above technical solution provided by the invention, the opening volume of the center magnet should satisfy: the ratio of the opening volume of the center magnet 32 to the volume of the center magnet 32 before opening is less than or equal to 35%, and can be further controlled to 5%-30%.

More specifically, the sound generator provided in the embodiment of the invention may further include: a centering support 400 provided between the diaphragm 21 and the voice coil 22, and a reinforcement part 23 provided on the side of the diaphragm 21 away from the magnetic circuit system 30; the reinforcement part 23 is fixed to the diaphragm 21, as shown in FIG. 1.

Figure 5:
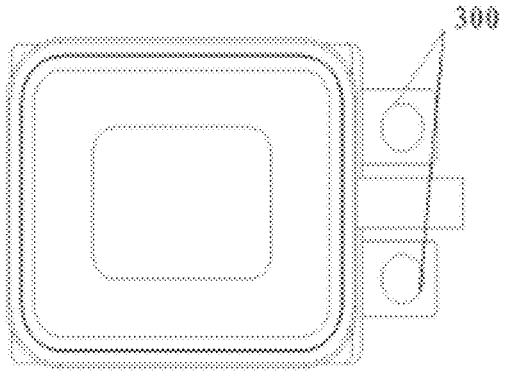
FIG. 5 is a schematic view of a top angle of a sound generator provided by an embodiment of the invention.
Figure 6:
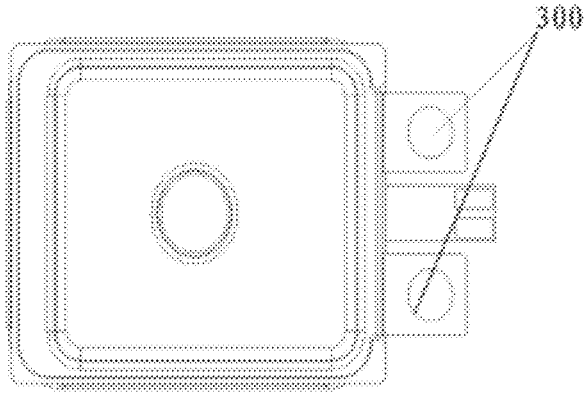
FIG. 6 is a schematic view of a bottom angle of a sound generator provided by an embodiment of the invention.
Figure 7:
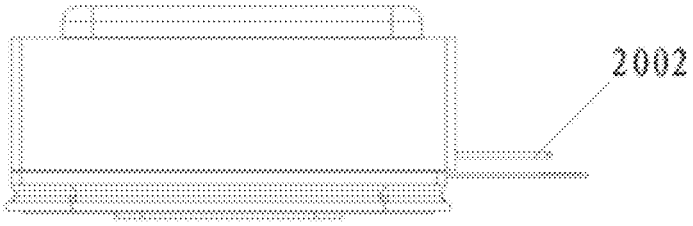
FIG. 7 is a schematic view of a side angle of a sound generator provided by an embodiment of the invention.

FIGS. 5, 6 and 7 show outer contour schematic diagrams of an implementation form of a sound generator provided by an embodiment of the invention. As shown in FIGS. 5, 6 and 7, the shell 10 of the sound generator provided in this embodiment may be a rectangular structure. For example, adopting the means that the sound generator of the technical solution provided by the embodiment of the invention can be prepared to have a plane size of (6-30) mm* (8-30) mm, and then by providing a rear sound hole with a capacity expansion effect on the magnetic circuit system, the purpose of reducing the height dimension of the sound generator is achieved.

Further, as shown in FIG. 1, an upper cover plate 70 installed on the shell 10 is further provided above the diaphragm 21.

The upper cover plate 70 can be ultrasonically welded to the first end of the shell 10.

Further, as shown in FIGS. 1 and 2, the rear sound hole 40 is provided with a breathable spacer 80, and the rear cavity 60 is filled with a sound absorbing material. The sound absorbing material may be zeolite material, activated carbon material, or other materials with capacity expansion effect, which is not limited in the present disclosure. It should be noted that the rear sound hole 40 includes a first rear sound hole 401 and a second rear sound hole 402. The breathable spacer 80 is a mesh cloth that allows air to pass and does not allow sound absorbing material to pass, and is used to isolate the sound absorbing material and prevent it from entering the magnetic circuit system. Filling the rear cavity with sound absorbing material can further increase the volume of the rear cavity, which helps to improve the performance of the sound generator. The way of providing the breathable spacer 80 directly on the rear sound hole 40 can use all the space of the rear cavity to fill the sound absorbing material, thus increasing the filling amount of the sound absorbing material, and achieving a better capacity expansion effect. And, according to the embodiment, "the magnetic circuit system 30 is provided with a through hole that sequentially penetrates the magnetic conductive yoke 31 and the central magnet 32 as a part of the rear cavity 60, and a second rear sound hole 402 communicating with the through hole is provided on the central magnetic conductive plate 33", in the case that the through hole penetrating through the magnetic conductive yoke 31 and the central magnet 32 increases the rear cavity and is filled with sound absorbing material for the capacity expansion, the second rear sound hole 402 is located at the center of the magnetic circuit system, and the contact rate between the sound absorbing material at the position of the through hole and the air can be increased to achieve the best capacity expansion effect.

Further, as shown in FIGS. 1 and 8, the shell bottom wall (not shown in the figures) or the lower cover plate 50 is provided with a filling hole 51 for filling the sound absorbing material, and a cover sheet 52 is encapsulated on the filling hole 51. The cover sheet 52 may be directly a hard sheet that is not air-permeable, and only serves to block the sound absorbing material. As an another embodiment, the cover sheet 52 is also provided with air-permeable micro-holes (not shown) that allow air to pass and do not allow the sound absorbing material to pass; or, the cover sheet 52 is provided with a leak hole (not shown), and the leak hole is covered with a damping net 53 (as shown in FIGS. 4 and 10) that allows air to pass and does not allow the sound absorbing material to pass. The above-mentioned specific embodiment makes the filling hole 51 serve as a leakage hole of the rear cavity, and can be used to balance the air pressure inside and outside the sound generator. Further, the acoustic resistance can be adjusted by adjusting the size of the air-permeable micro-holes or the mesh size of the damping net.

In an actual implementation, a lower cover plate 50 is installed at the second end opening of the shell 10. The lower cover plate 50 in this embodiment may be made of a metal, and the metal material may be made thinner and occupy less space. The lower cover plate 50 is of a flat plate shape; or, the lower cover plate 50 is of a bowl-shaped structure provided with a bottom 501 and a side wall 502 (as shown in FIG. 2). In the embodiment in which the lower cover plate 50 is made of metal and is of a bowl-shaped structure, the metal lower cover plate 50 of the bowl-shaped structure has high strength and takes up little space, and the presence of the side wall 502 forms a part of the rear cavity space. Therefore, the height of the shell 10 can be reduced, thereby avoiding the problem that the excessively high plastic shell needs to increase the wall thickness to ensure the overall structural strength, which will increase the occupied space, and is more conducive to miniaturization of the product.

In the sound generator provided in this embodiment, the lower cover plate 50 may be connected to the second end opening of the shell 10 in the following two ways. Of course, the embodiments of the present invention are not limited to the following ways for connection.

Figure 2A:
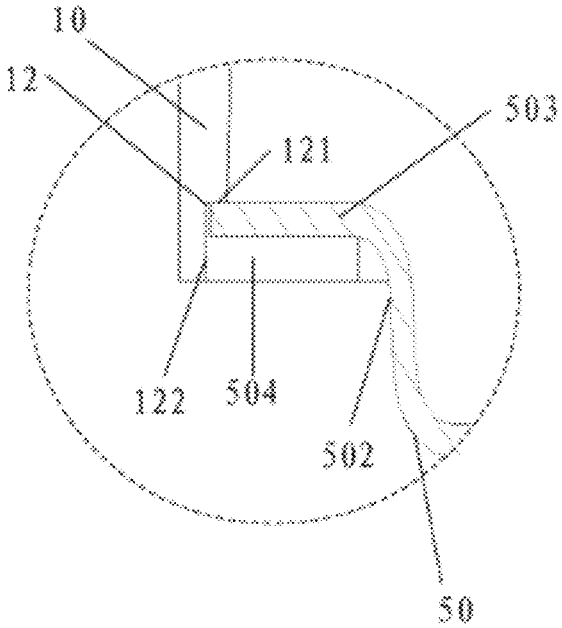
FIG. 2A is a partially enlarged schematic view of FIG. 2.

In a first way, as shown in FIG. 2, an inner side of the end surface of the second end opening of the shell 10 is provided with a recessed second stepped end surface 12, the second stepped end surface 12 is provided with a top surface 121 and a side surface 122 for mounting the lower cover plate 50. The lower cover plate 50 is of a flat plate shape (not shown), an edge of the lower cover plate 50 is provided with a recessed portion recessed towards the rear cavity 60, the recessed portion abuts on the top surface 121 of the second stepped end surface, a first glue holding groove 5 is formed between the side surface 122 of the second stepped end surface 12, and the first glue holding groove is coated with glue to fix the lower cover plate 50 on the shell 10. Alternatively, as shown in FIGS. 2 and 2A, the lower cover plate 50 is of a bowl-shaped structure provided with a bottom wall 501 and a side wall 502, an end of the side wall 502 of the lower cover plate 50 is bent outward to provide a mounting edge 503, the mounting edge 503 abuts on the top surface 121 of the second stepped end surface 12, a second glue holding groove 504 is formed between the side surface 122 of the second stepped end surface 12, and the second glue holding groove 504 is coated with glue to fix the lower cover plate 50 on the shell 10.

In the second way, a plastic edge (not shown) is injection-molded on a periphery of the lower cover plate 50, and the plastic edge is ultrasonically welded to the second end opening of the shell 10.

In an another specific embodiment, the first end of the shell 10 may be open, and the second end portion of the shell 10 is integrally provided with a shell bottom wall, the shell bottom wall is all made of a plastic material; or, the shell bottom wall comprises an integrally molded metal sheet for increasing the space.

Yet another embodiment of the present invention provides an electronic product. The electronic product comprises an assembly case of the electronic product, wherein the sound generator according to any one of embodiments is mounted in the assembly case; as shown in FIG. 4, the metal sheet 200 comprises a main body portion 2001 fixed on the side wall of the shell 10, and at least one fixing portion 2002 bent outwards from an end of the main body portion 2001, and a positioning hole 300 is provided on the fixing portion 2002; the sound generator and the assembly case are fixed together by the positioning hole 300 on the fixing portion 2002; and, a camera is mounted at a position, corresponding to a side, provided with the metal sheet 200 of the sound generator, in the assembly case. With this arrangement, the metal sheet 200 can effectively shield the magnetic leakage that affects the operation of the camera.

The above mentioned electronic product includes but is not limited to mobile phones, PDAs, etc.

Although some specific embodiments of the invention have been demonstrated in detail by way of illustration, it should be understood by a person skilled in the art that the above examples are only intended to be illustrative and not to limit the scope of the invention. It should be understood by a person skilled in the art that the above embodiments can be modified without departing from the scope and spirit of the present invention. The scope of the present invention is defined by the attached claims.

The invention claimed is:

1. A sound generator, comprising a shell, a vibration system and a magnetic circuit system; wherein, the vibration system and the magnetic circuit system are sequentially accommodated and fixed at a first end of the shell from top to bottom;

the magnetic circuit system is provided with a rear sound hole;

the shell comprises a first portion corresponding to the vibration system and the magnetic circuit system, and a second portion integrally extending downward from the first portion beyond a bottom surface of the magnetic circuit system;

a second end portion of the shell is selected from the group consisting of a shell portion integrally provided with a shell bottom wall and a shell portion separately mounted with a lower cover plate;

and wherein a rear cavity in communication with the rear sound hole formed between the second portion of the shell, the bottom surface of the magnetic circuit system and the shell bottom wall or the lower cover plate; and the shell comprises a side wall, a metal sheet for shielding magnetic leakage being provided on the side wall of the shell, the metal sheet comprises a main body portion fixed on the side wall of the shell, and at least one fixing portion bent outwards from an end of the main body portion, and a positioning hole is provided on the fixing portion.

2. The sound generator according to claim 1, wherein, the shell is a straight cylinder structure with an openings at the first end and an opening at the second end;

the vibration system comprises a diaphragm and a voice coil fixed below the diaphragm, the diaphragm being fixed on an end surface of the first end opening of the shell; and the lower cover plate is mounted at the second end opening of the shell.

3. The sound generator according to claim 1, wherein, the metal sheet is an individual component, and the metal sheet is injection-molded and fixed on the side wall of the shell.

4. The sound generator according to claim 1, wherein, the lower cover plate is mounted at the second end opening of the shell;

the lower cover plate is made of a metal, the metal sheet is integrally provided with the lower cover plate, the metal sheet is formed by a bent-upwards extension of an edge of the lower cover plate, and the metal sheet is fixed on the side wall of the shell.

5. The sound generator according to claim 4, wherein, a groove is provided on a position, corresponding to the metal sheet, on the side wall of the shell, and the metal sheet is embedded in the groove and fixed to a bottom of the groove.

6. The sound generator according to claim 1, wherein, the magnetic circuit system comprises a magnetic conductive yoke, and a central magnetic circuit portion and a side magnetic circuit portion that are mounted on an upper surface of the magnetic conductive yoke;

a magnetic gap is formed between the central magnetic circuit portion and the side magnetic circuit portion; and at least one of the central magnetic circuit portion and the side magnetic circuit portion is provided with a permanent magnet.

7. The sound generator according to claim 1, wherein, an outer side of the magnetic circuit system is provided in close contact with an inner wall of the shell.

8. The sound generator according to claim 6, wherein the magnetic conductive yoke is rectangular, and a corner of the magnetic conductive yoke is provided with a first rear sound hole in communication with the magnetic gap and the rear cavity;

the rear sound hole comprises the first rear sound hole.

9. The sound generator according to claim 6, wherein the central magnetic circuit portion comprises a central magnet and a central magnetic conductive plate provided on a top surface of the central magnet; at the central magnetic circuit portion, the magnetic circuit system is provided with a through hole that sequentially penetrates the magnetic conductive yoke and the central magnet as a part of the rear cavity, and a second rear sound hole in communication with the through hole is provided on the central magnetic conductive plate;

the rear sound hole comprises the second rear sound hole.

10. The sound generator according to claim 1, wherein an upper cover plate mounted on the shell is provided above the diaphragm.

11. The sound generator according to claim 1, wherein the shell is of a rectangular structure.

12. The sound generator according to claim 1, wherein, the rear sound hole is provided with a breathable spacer, and the rear cavity is filled with a sound absorbing material.

13. The sound generator according to claim 12, wherein the shell bottom wall or the lower cover plate is provided with a filling hole for filling the sound absorbing material, and a cover sheet is encapsulated on the filling hole.

14. The sound generator according to claim 1, wherein the lower cover plate is mounted at the second end opening of the shell, and the lower cover plate is made of a metal;

an inner side of an end surface of the second end opening of the shell is provided with a recessed second stepped end surface, the second stepped end surface is provided with a top surface and a side surface for mounting the lower cover plate;

the lower cover plate is of a bowl-shaped structure provided with a bottom wall and a side wall, an end of the side wall of the lower cover plate is bent outward to provide a mounting edge, the mounting edge abuts on the top surface of the second stepped end surface, a second glue holding groove is formed between the mounting edge and the side surface of the second stepped end surface, and the second glue holding groove is coated with glue to fix the lower cover plate on the shell; or a plastic edge is injection-molded on a periphery of the lower cover plate, and the plastic edge is ultrasonically welded to the second end opening of the shell.

15. An electronic product, comprising an assembly case of the electronic product, wherein the sound generator according to claim 1 is mounted in the assembly case;

the sound generator and the assembly case are fixed together by the positioning hole on the fixing portion;

and, a camera is mounted at a position, corresponding to a side, provided with the metal sheet of the sound generator, in the assembly case.

* * * * *